United States Patent [19]

Chauvier et al.

[11] Patent Number: 4,789,364

[45] Date of Patent: Dec. 6, 1988

[54] DISPLACEMENT APPARATUS FOR SUBMERGED CLEANER

[76] Inventors: Daniel J. V. D. Chauvier; Peter Woodman, both of 57 Miller Road., Nuffield Springs, South Africa

[21] Appl. No.: 30,132

[22] Filed: Mar. 26, 1987

[30] Foreign Application Priority Data

Mar. 27, 1986 [ZA] South Africa ..... 86/2317

[51] Int. Cl.[4] ..... B63H 21/165

[52] U.S. Cl. ..... 440/5; 15/1.7; 134/168 R

[58] Field of Search ..... 440/5, 39; 15/1.7; 134/167 R, 168 R; 210/169

[56] References Cited

U.S. PATENT DOCUMENTS 1,689,114 10/1928 Choquette ..... 440/5
1,735,641 11/1929 Garcia ..... 440/5
3,229,315 1/1966 Watson ..... 15/1.7

FOREIGN PATENT DOCUMENTS 737147 7/1974 South Africa .

*Primary Examiner*—Sherman D. Basinger

[57] ABSTRACT

Submersible displacement apparatus 10 for periodically displacing a submersible suction cleaner connected to a suction source by a suction hose is disclosed. The apparatus 10 comprises a body 11 defining two converging flow passages 12 and 16 therethrough. Flow passage 16 is connectable in the hose with outlet 14 communicating with the source. Flow passage 12 at its inlet has a valve 17 for periodically opening and closing that passage. An actuation mechanism driven by water wheel 28 is provided for opening and closing valve 17. An impeller is rotatably mounted in passage 12 to drive propeller 20 when water is admitted through valve 17 thereby periodically to exert a displacement force on the body and therefore also on the suction cleaner.

7 Claims, 4 Drawing Sheets

DISPLACEMENT APPARATUS FOR SUBMERGED CLEANER

This invention relates to submersible swimming pool cleaners adapted to be connected to a treatment plant by a suction hose and in particular it relates to apparatus for and a method of displacing the suction hose and/or the cleaner in order to free the cleaner from a submerged obstacle.

Submersible suction cleaners of the kind adapted to move about in a swimming pool under the influence of kinetic energy imparted to the cleaner due to the intermittent variation in water flow through the cleaner may suffer from the disadvantage that when the cleaner becomes stuck against an obstacle in the pool such as the steps, the normal driving mechanism of the cleaner may not be able to free the cleaner in order for it to continue on its random path. It may accordingly remain trapped until manually displaced.

Various devices are available for solving the above problem. One such a known device is the so-called "Jogger cone". This device comprises a hollow dome-like member defining a central opening so that it may be mounted about the suction hose with the apex of the dome pointing away from the cleaner. In use, the dome which is submerged in the water, causes a longitudinally pulsating hose to be displaced in a direction away from the cleaner, thereby pulling the cleaner away from the obstruction by the hose.

Another known device comprises a sail carrying float adapted to be attached to the hose. When the wind causes the float to sail, the hose is displaced which in turn causes the cleaner to be displaced and freed. Obviously, when these is no breeze the device is inoperative and generally this mechanism does not function efficiently.

Both the abovementioned passive devices accordingly exert a force on the hose and therefore also on the cleaner, but this force may under certain circumstances have an undesirable effect on the cleaner's intended random motion in the pool.

It accordingly is an object of the present invention to provide alternative apparatus for displacing the hose and/or the cleaner, which apparatus it is believed will alleviate at least some of the abovementioned problems. It is also an object of the invention to provide a novel method of displacing the hose and/or the cleaner.

According to the invention, apparatus for periodically displacing a device submerged in a liquid comprises:

a body adapted to be connected directly or indirectly to the device;

the body defining first and second flow passages therethrough;

the first flow passage extending between a first inlet to the body and an outlet therefrom;

the second flow passage extending between a second inlet to the body and the outlet;

the second inlet being adapted to communicate with the device and the outlet being adapted to be connected to a suction source so that suction is transmitted via the body and second inlet to the device;

a valve assembly for the first flow passage for periodically opening and closing the flow passage;

actuating means for operating the valve assembly which actuating means is driven by liquid flow through the body; and drive means operable by a stream of liquid to exert a force on the body and thereby also on the submerged device to displace the same when the valve assembly is caused to open to admit liquid through the first inlet.

The drive means may comprise a propeller connected to be driven by an impeller rotatably mounted near the first inlet and operative to drive the propeller when liquid is admitted through the first inlet.

The valve assembly is preferably mounted at the first inlet and comprises a tubular body member having at least one circumferential hole therein and a sleeve member rotatably mounted upon the tubular body member, the sleeve member having at least one circumferential opening therein to register with the hole when the sleeve member is in a selected position thereby to admit liquid through the valve and through the first inlet.

In the preferred embodiment the impeller is rotatably mounted in the valve body member.

The actuating means may comprise a water driven member and a gear train connected at its input to the water driven member and at its output to the valve assembly.

The water driven member may comprise a water wheel rotatably mounted in the body of the apparatus and a gear may be provided on the valve sleeve member which gear is adapted to be driven by the gear train.

The displacement apparatus according to the invention may also comprise a float connectable to the body such that the propeller, in use, is maintained submerged in the liquid.

According to another aspect of the invention a method of periodically displacing a device submerged in a liquid comprises the steps of:

providing a displacement apparatus defined first and second flow passages therethrough and adapted for propulsion by operation of a stream of liquid flowing through the first flow passage;

connecting the apparatus to the device so that the second flow passage forms part of a flow path between the device and a suction source;

causing a stream of liquid to flow through the first flow passage; and utilising the stream to propel the apparatus and thereby to cause displacement of the device.

In the preferred form of the method liquid is periodically admitted to flow through said first flow passage thereby periodically to propel the displacement apparatus.

This invention will now further be described by way of example only with reference to the accompanying diagrams wherein.

Figure 3:
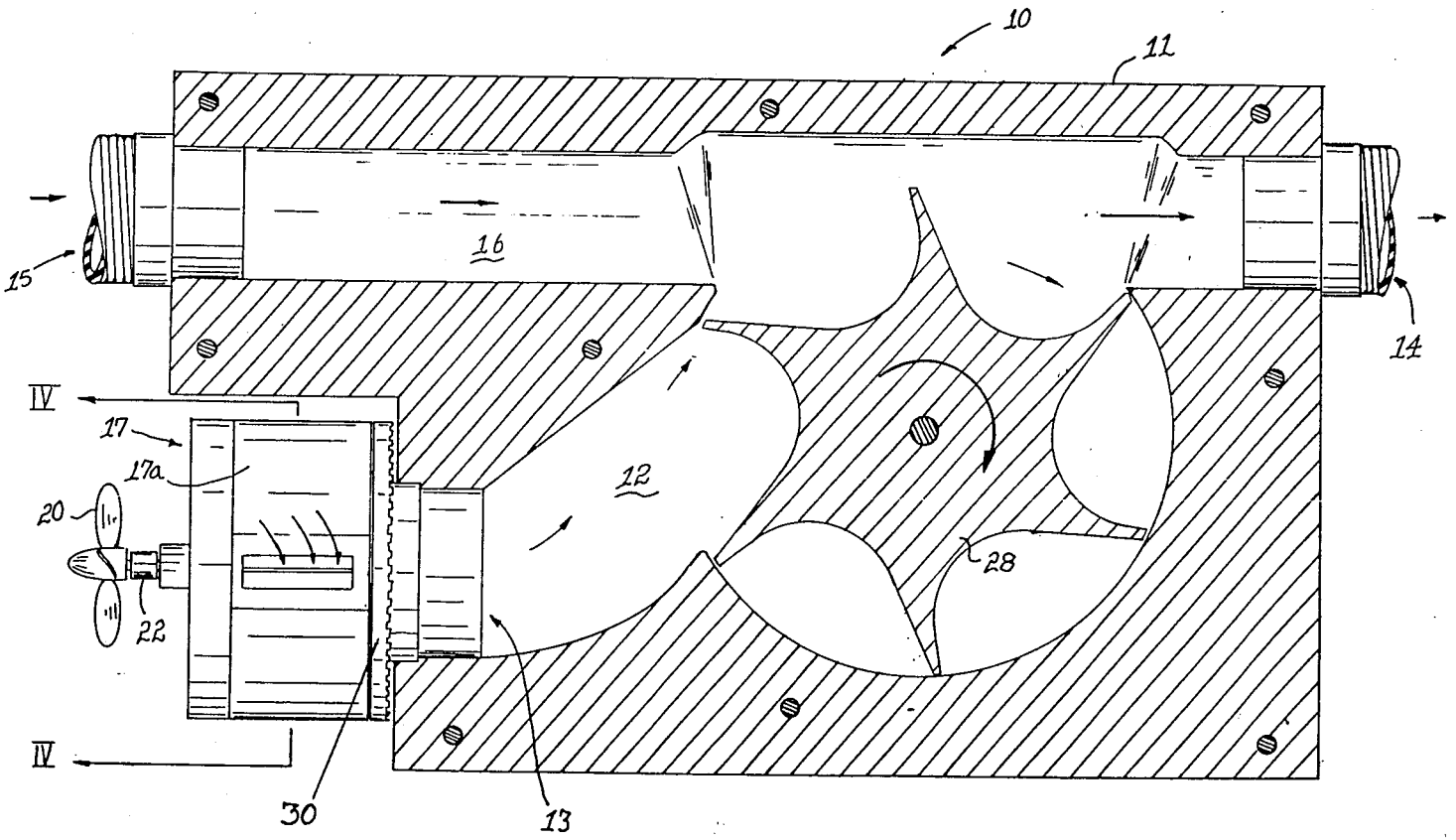
FIG. 3 is a longitudinal sectional side view of the apparatus shown in FIG. 2.
Figure 4A:
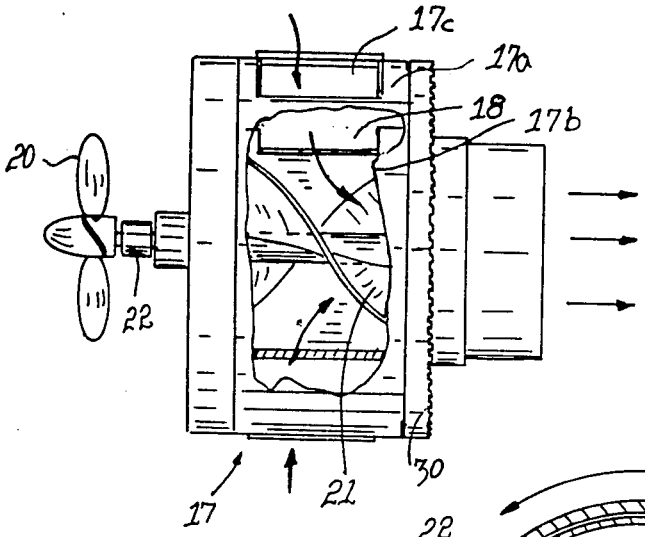
Figure 4B:
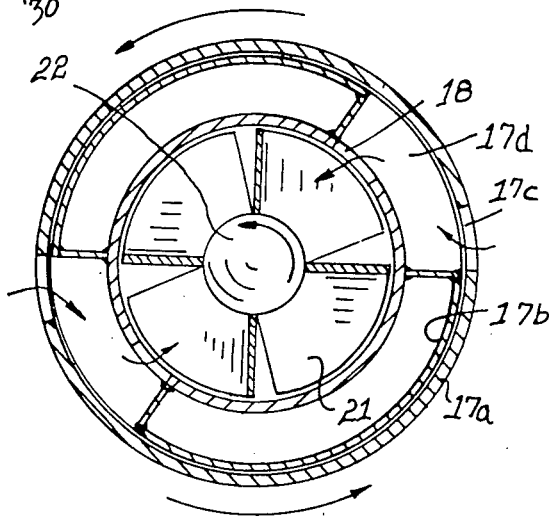

FIG. 4*a* is a side view of a valve forming part of the displacement apparatus with part thereof broken away, and FIGS. 4*b* and *c* are transverse sectional views along line IV—IV of the valve of FIG. 3 in its open and closed conditions, respectively.

Figure 1:
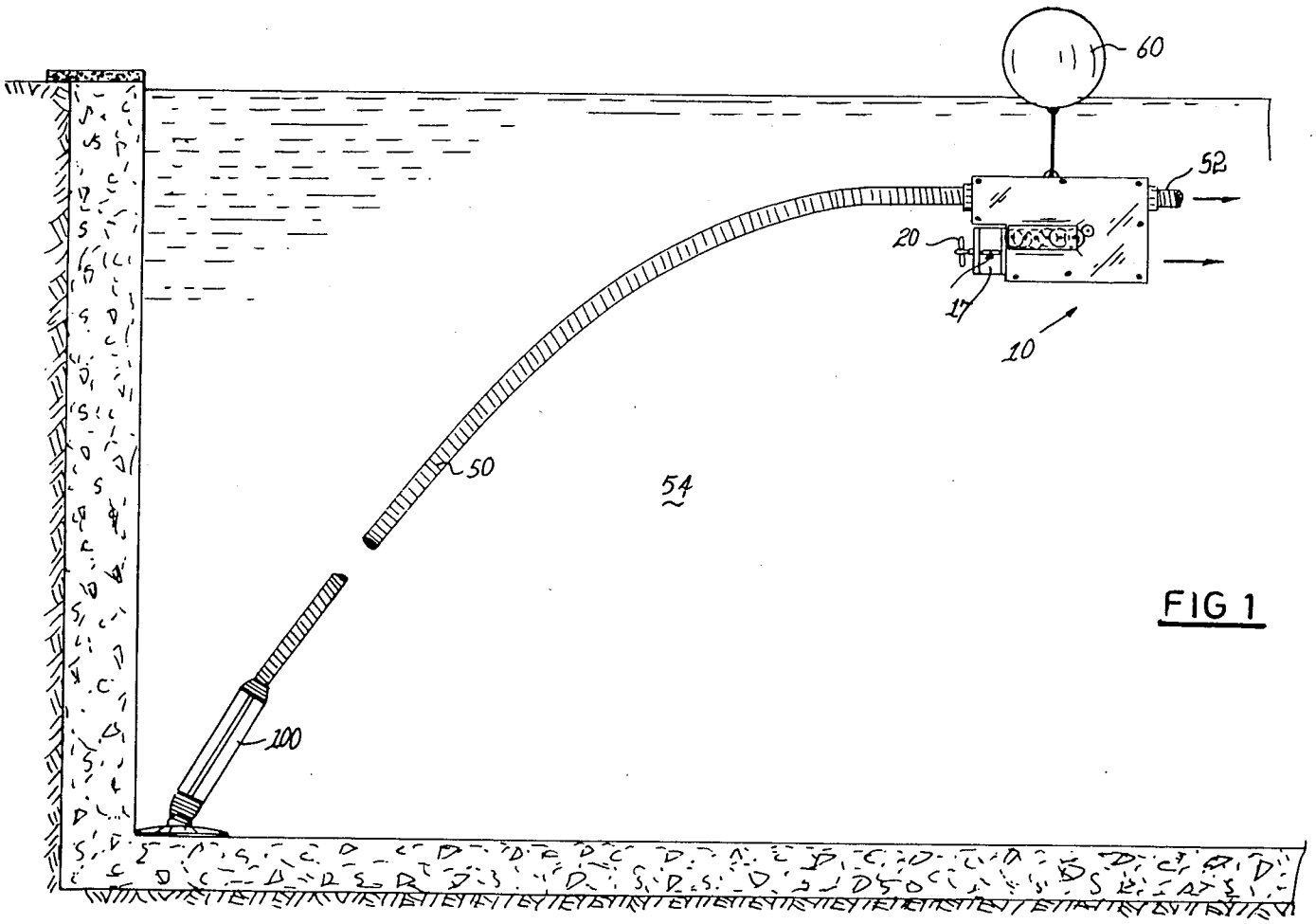
FIG. 1 is a diagrammatic view of a displacement apparatus according to the invention, connected into a suction hose.
Figure 2:
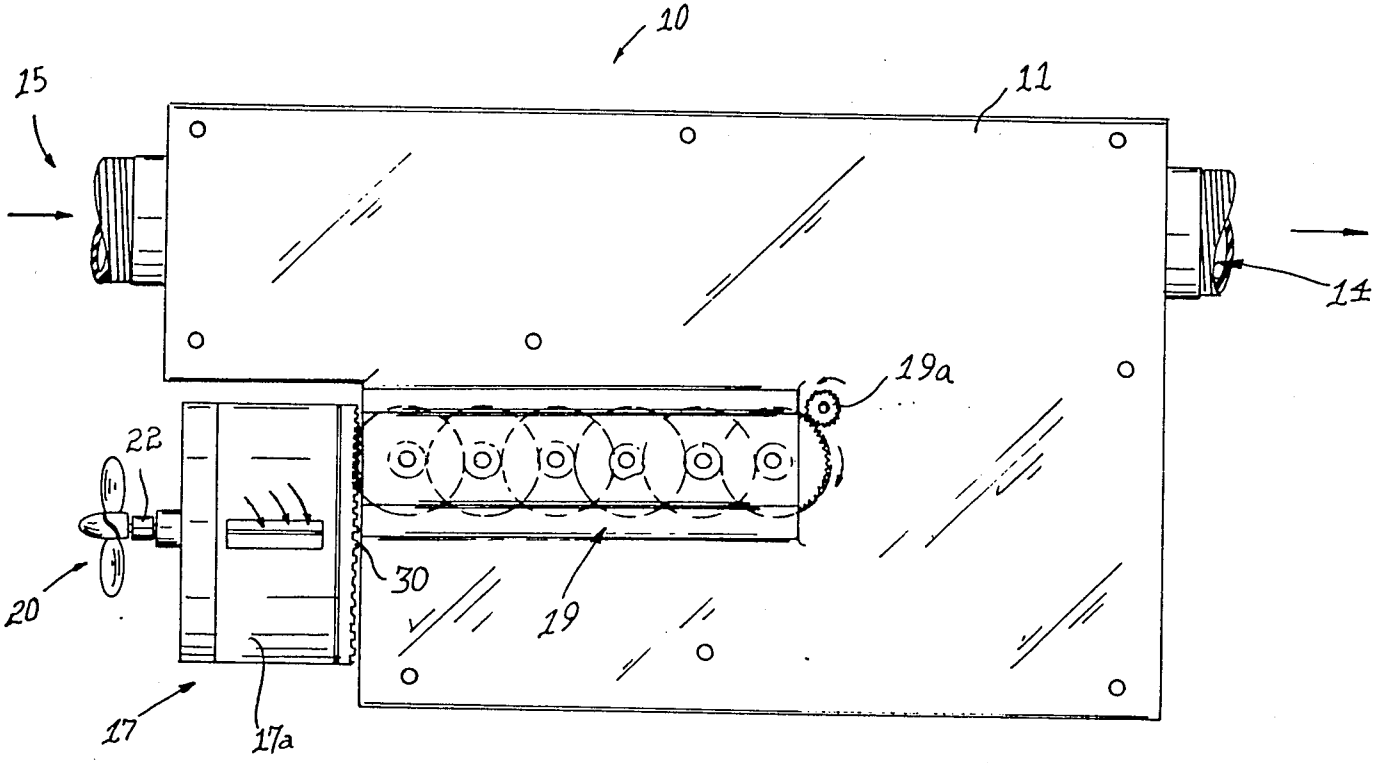
FIG. 2 is a diagrammatic side elevation of one embodiment of the displacement apparatus according to the invention.

A submersible displacement apparatus for a submersible suction cleaner is generally designated by the reference numeral 10 in FIGS. 1 to 3. As shown in FIG. 1 displacement apparatus 10 is connected to suction cleaner 100 by flexible suction hose 50 and to a treatment plant (not shown) by a similar hose 52. The cleaner 100 may be of the kind adapted to move about in a swimming pool 54 under the influence of kinetic energy imparted to the cleaner due to an intermittent variation in the flow of water through the cleaner. An example of such a cleaner is that displaced in U.S. Pat. No. 4,023,227 to F L O J Chauvier.

The displacement apparatus, as more clearly shown in FIG. 3, comprises a body 11 defining a first flow passage 12, between a first inlet 13 and an outlet 14, for a stream of water flowing towards the treatment plant and a second flow passage 16, between a second inlet 15 and outlet 14. The body of the second inlet 15 and outlet 14 is adapted to be connected into hoses 50 and 52 so that the second flow passage 16 constitutes part of the flow path between cleaner 100 and the treatment plant. The flow path is mainly defined by suction hoses 50 and 52. The apparatus 10 is maintained in a submerged position just below the surface by means of a float 60 as shown in FIG. 1.

As best illustrated in FIG. 3 in conjunction with FIG. 1, the apparatus 10 also comprises drive means in the form of a propeller 20 for propelling the apparatus thereby to displace hose 50 and therefore cleaner 100 to free it from an obstacle, such as a step or the like, in pool 54 which it in the mean time may have encountered.

An important feature of the displacement apparatus 10 according to the invention is that the stream of water flowing through the first inlet 13 via the first flow passage 12 to the treatment plant is utilised to drive the propeller 20 thereby to displace the hose. Hence, when water is flowing through that flow passage apparatus 10 will exert a force on the hose 50 while, when there is no flow of water through that flow passage, the apparatus will be inactive and floating about in pool 54 under the influence of cleaner 100, driven by its normal driving mechanism to move about in pool 54.

A valve assembly 17 which is associated with the first inlet 13 is also provided. This valve assembly is arranged alternately to open and close inlet 13. Accordingly, water will only be able to flow through first flow passage 12 when inlet 13 is open. Valve assembly 17 is further adapted to be open for periods substantially shorter than the periods during which it will be closed. Hence, propeller 20 will be caused to rotate for a short period during a cycle of the valve operation, which operation will be explained in more detail hereunder.

As more clearly shown in FIG. 4*a*, valve assembly 17 comprises a tubular valve body 17*b* and a sleeve member 17*a* rotatably mounted upon body member 17*b*. Sleeve 17*a* defines two longitudinally extending and diametrically opposed slots 17*c*. Valve body 17*b*, on the other hand, defines two diametrically opposed peripheral cavities 17*d* therein both leading to inlets 18 and which inlets communicate with the interior of the valve body where an impeller 21 is located.

Impeller 21 is adapted to be driven by the stream of water entering through valve 17 and, in turn, to drive propeller 20 connected thereto by propeller shaft 22.

Figure 4C:
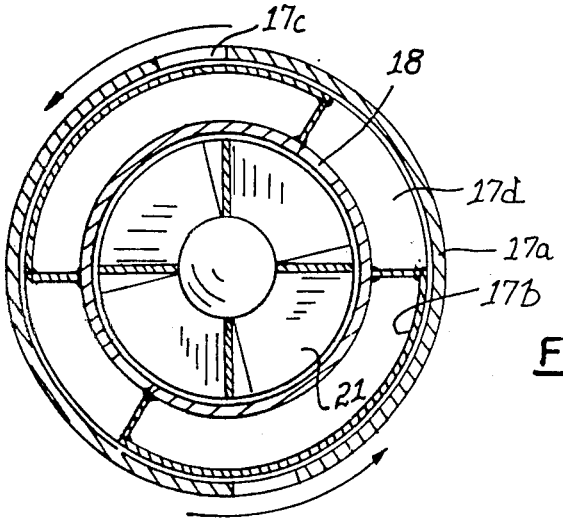

It will be clear that when slots 17*c* in sleeve member 17*a* are in register with cavities 17*d* in valve body 17*b*, as shown in FIG. 4*b*, water will enter through inlets 18 to flow onto the impeller blades, and then through the first inlet 13 and first flow passage 12 towards the treatment plant. As explained above this stream of water will cause impeller 21 to rotate which in turn will drive propeller 20. However, when the slots 17*c* are not in register will the cavities 17*d*, as shown in FIG. 4*c*, no water will enter valve 17 with the effect that displacement apparatus 10 will be floating passively in pool 54.

Sleeve 17*a* is adpated rotatably to be driven about the valve body 17*b* thereby alternately to bring slots 17*c* and cavities 17*d* into and out of register.

As shown in FIG. 3 in conjunction with FIG. 2, sleeve 17*a* is driven by a water wheel 28 (shown in FIG. 3), which is drivingly coupled via pinion 19*a* to a gear train 19 as shown in FIG. 2. Gear train 19 is adapted to mesh with and hence drive a gear 30 mounted at the inboard end of valve sleeve member 17*a*, adjacent the first inlet 13.

When inlet 13 is closed, water from the cleaner 100 flows through second flow passage 16 towards the treatment plant. The flow of water over the water wheel 28 causes it to rotate and hence rotatably to drive sleeve member 17*a* about the valve body 17*b*. When the slots 17*c* and cavities 17*d* come into register, water enters through valve 17 to drive impeller 21. As above described, the displacement apparatus 10 now is operative to displace hose 50 and cleaner 100 to free it from any obstacles which it may have encountered in the mean time.

As the stream of water flowing through the flow passage 12 passes water wheel 28 it, together with the stream, through the second flow passage 16, cause wheel 28 to rotate. At a certain stage slots 17*c* in sleeve member 17*a* will again be out of register with cavities 17*d*, so that valve 17 consequently will be closed. The apparatus now is in an inoperative condition and accordingly will exert no displacement force on hose 50 with the effect that the cleaner 100 will be free to move about in the pool according to its intended random pattern.

Various changes and modifications apparent to those skilled in the art may be made without departing from the spirit and scope of the invention. For example, although the displacement apparatus described hereabove with reference to the accompanying diagrams is a unit separate from the cleaner, it is will be clear to those skilled in the art that the displacement apparatus in other embodiments may form part of the cleaner head or body to constitute a single unit.

What is claimed is:

1. Apparatus for intermittently displacing a device submersible in a liquid, comprising:

a body adapted to be connected directly or indirectly to the device;

the body defining first and second flow passages therethrough;

the first flow passage extending between a first inlet to the body and an outlet therefrom; the second flow passage extending between a second inlet to the body and the said outlet;

the second inlet being adapted to communicate with the device and the outlet being adapted to be connected to a suction source so that suction is transmitted via the body and the second inlet to the device;

drive means adapted to exert a displacement force on the body and therefore on the device in response to liquid flow through the first flow passage;

a valve assembly for the first flow passage for intermittently opening and closing the first flow passage to intermittently allow and interrupt liquid flow through the first flow passage; and actuating means for operating the valve assembly which actuating means is driven by liquid flow through the body;

the arrangement being such that, in use, when liquid is flowing through the first flow passage, the drive means is operative to exert a displacement force on the body and therefore on the device, and, when liquid flow through the first flow passage is interrupted, the drive means is rendered completely inoperative and no displacement force is then exerted on the body.

2. Apparatus as claimed in claim 1 wherein the drive means comprises a propeller connected to be driven by an impeller rotatably mounted near the first inlet and operative to drive the propeller when liquid is admitted through the first inlet.

3. Apparatus as claimed in claim 2 further comprising a float connectable to the body such that the propeller in use is maintained submerged in the liquid.

4. Apparatus as claimed in claim 1 wherein the valve assembly is mounted at the first inlet and comprises a tubular body member having at least one circumferential hole therein and a sleeve member rotatably mounted upon the tubular body member, the sleeve member having at least one circumferential opening therein to register with the hole when the sleeve member is in a selected position thereby to admit liquid through the first inlet.

5. Apparatus as claimed in claim 4 wherein an impeller is rotatably mounted in the tubular body member.

6. Apparatus as claimed in claim 1 wherein the actuating means comprises a water driven member and a gear train connected at its input to the water driven member and at its output to the valve assembly.

7. Apparatus as claimed in claim 6 wherein the water driven member comprises a water wheel rotatably mounted in the body of the apparatus and wherein a gear is provided on a sleeve member which gear is adapted to be driven by the gear train.

* * * * *